US006878022B2

(12) United States Patent
Yasuda et al.

(10) Patent No.: US 6,878,022 B2
(45) Date of Patent: Apr. 12, 2005

(54) OUTBOARD MOTOR

(75) Inventors: Toyoshi Yasuda, Wako (JP); Makoto Yazaki, Wako (JP); Shinichi Ide, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/616,423

(22) Filed: Jul. 9, 2003

(65) Prior Publication Data

US 2004/0014379 A1 Jan. 22, 2004

(30) Foreign Application Priority Data

Jul. 18, 2002 (JP) ..... 2002-209990
Jul. 18, 2002 (JP) ..... 2002-210014

(51) Int. Cl.[7] ..... B63H 21/36
(52) U.S. Cl. ..... 440/76; 440/77
(58) Field of Search ..... 123/195 P, 195 C; 440/76, 77

(56) References Cited

U.S. PATENT DOCUMENTS 3,358,668 A * 12/1967 Post et al. ..... 123/198 E
5,360,358 A * 11/1994 Haman ..... 440/77
5,487,687 A * 1/1996 Idzikowski et al. ..... 440/77
5,921,827 A * 7/1999 Ichihashi ..... 440/77

FOREIGN PATENT DOCUMENTS

JP 55083696 6/1980
JP 6234393 8/1994

* cited by examiner

*Primary Examiner*—Sherman Basinger
(74) *Attorney, Agent, or Firm*—Adams & Wilks

(57) ABSTRACT

An outboard motor has an engine, a propeller drivable by the engine, and a drive shaft for transmitting a driving force from the engine to the propeller. A casing assembly supports the engine and rotatably supports and accommodates the drive shaft. A cover structure defines at least part of an engine space accommodating therein the engine. The cover structure has a resin cover body comprised of at least first and second cover members detachably connected to one another, and a frame assembly integrally connected to an inner surface of the first cover member for reinforcement threof. The first cover member has an opened flange receiving a seal of the second cover member. The frame assembly extends along a contour of the opened flange.

13 Claims, 15 Drawing Sheets

OUTBOARD MOTOR

BACKGROUND OF THE INVENTION

1. Field of the Invention

The present invention relates to an outboard motor and, more particularly, an improvement in a cover structure and a drain structure in an engine space of the outboard motor.

2. Background Information

A body of an outboard motor is conventionally formed from an aluminum alloy. In recent years, however, a demand has grown for a new engine-housing cover made from resin for reduction in weight and cost. A combination of a synthetic resin lower cover divided generally into left and right halves and a synthetic resin upper cover demountably mounted on the lower cover, for example, has been put to practical use.

In the cover, the engine space is made as large as possible for easy engine mounting operation and maintenance. Resin molded parts, however, have smaller rigidity as compared to aluminum alloy parts. It is especially required to provide a resin lower-half cover supporting a demountable cover with sufficient rigidity.

For securing the rigidity of a resin cover, a cover with a ribbed configuration is presented, for example, in Japanese Patent Laid Open Publication No. HEI-6-234393. This cover structure avoids the influence of sink marks due to ribs on the shell member consisting of resin parts.

However, the above cover, whose ribbed configuration needs to be thickened, requires verification by trial that sink marks do not appear on the exterior of the resin cover, taking time to be commercialized and having disadvantages in quantity production and cost.

When the ribs of the above ribbed resin cover cooperate with another body part to be fitted thereto to constitute a bottom portion constituting part of a partition wall for the engine space, the existence of webs requires another consideration to the withdrawal direction from the mold or prevents grooves from being made much deep in view of the draft for the ribs, resulting in a limited degree of freedom in design.

Thus desired is an outboard motor with an external cover such as an engine cover of a resin cover which has secured rigidity without being made thick, facilitating the production, and having a cost benefit.

An outboard motor allowing for maximum prevention of entering of water from the outside into the engine space which houses the engine is also known. This outboard motor is configured to quickly drain water entering from the outside.

For drainage, a small opening has been conventionally provided, for example. Provision of such a small opening, however, contrarily leads to entering of water from outside.

A "Drain Device for Outboard Motor" having a drain opening for discharging water entered into the engine space, and provided with a check valve for preventing entry of water from the drain opening into the engine space has been presented, for example (Japanese Patent Laid-Open Publication No. SHO-55-83696).

This drain device, however, has a cost disadvantage due to the provision of the check valve. A drain portion formed by cutting off part of a resilient sealing member fitted onto a flange provided below the engine has a vertical passage structure with a simple opening shape. Entry of water from the outside is thus prevented only by the shutting-off function of the check valve.

In this context, an outboard motor capable of preventing extraneous water from entering the engine space of the outboard motor and of smoothly draining entered extraneous water with a simple structure is desired.

SUMMARY OF THE INVENTION

According to an aspect of the present invention, there is provided an outboard motor which comprises: an engine; a propeller to be driven by the engine; a drive shaft for transmitting a driving force from the engine to the propeller; casing means for supporting the engine and rotatably housing the drive shaft; and a cover forming at least a part of an engine space housing the engine, which cover comprises: a resin cover body; and a resin frame assembly integrally fixed to inside surfaces of the cover body.

Since the cover body of the outboard motor is made from resin and the resin frame assembly is integrally fixed to the inside of the cover body, sink marks conventionally occurring in molding in which ribs are integrally provided to the inside of a resin cover body do not occur, and the need for any measures against sink marks is eliminated, and there is no influence on the appearance of the resin cover body. There is thus provided a resin cover of an outboard motor in good appearance, which uses a cover reinforcement structure for the cover while having no influence on the appearance, resulting in a good appearance of a main part constituting the appearance of the outboard motor.

The resin cover body constituting the external cover of the outboard motor has increased rigidity with the resin frame assembly integrally provided on the inside surfaces, securing required rigidity even when an opening or the like for maintenance is made larger. The secured or increased rigidity is realized by integrating the frame assembly to the inside surfaces by welding or the like after the cover is molded, which facilitates production of a resin cover having high rigidity and providing good appearance to an outboard motor, allowing reduction in weight and providing a cost benefit.

Preferably, the cover body preferably has holding portions on the inside surfaces for fixing the frame assembly thereto, so as to facilitate the fixing of the resin frame assembly and eliminate any influence on the appearance of the resin cover.

In a preferred form, the cover body comprises a lower cover and an upper cover demountably mounted on the lower cover, which lower cover has flanges serving both as seals for the upper cover and as fixing portions for the frame assembly. Thus, the sealing and fixing functions can be performed by a single part, resulting in a simplified structure of fixing portions of the frame assembly and a simplified structure of the cover body provided with the reinforcing frame assembly.

Desirably, frame members constituting parts of the frame assembly function as a flange at the bottom periphery of the engine space. A single component can thus have multifunctions, resulting in a simplified structure.

Preferably, frame members constituting parts of the frame assembly contact or engage a peripheral portion of a mounting case substantially constituting the bottom of the engine space, thereby constituting the bottom of the engine space and defining the engine space within the exterior cover. Thus, no additional components for separating the engine space are required. The multifunctional components and the contact or engagement of the periphery of the mounting case to or with the frame members allow the separation of the inside of the cover body above and below to define the engine space, resulting in a further simplified structure and facilitated production.

It is preferred that the frame assembly provided on the inside of the cover body comprises lateral frame members provided in upper and lower positions and extending in a rearward-and-forward direction, and a plurality of vertical frame members connecting the upper and lower lateral frame members. The rigidity of the frame-assembly is thus increased, resulting in a resin cover structure of high rigidity even with the resin frame assembly integrally fixed to the resin cover.

Preferably, the cover has a cover body forming the engine space housing the engine, and drain passages extending from the inside of the cover body to the outside of the cover body; which drain passages have inlets facing the engine space and outlets facing the outside of the engine space; which inlets and outlets are provided in positions distanced vertically and also distanced laterally of the outboard motor.

The external water inlets and outlets are thus in a labyrinthine arrangement in which water entering in the direction opposite to the drainage direction, that is, external water entering through the outlets into the drain passages strikes the ceilings of the drain passages because the inlets are not located immediately above the outlets, attenuated in energy by change of direction, and hardly enters the engine space. The simple structure can thus prevent the entering of external water into the engine space of the outboard motor and drain entering external water smoothly.

In a preferred form, the cover body is a resin cover and has hollow frame members integrally fixed to the inside surfaces of the cover body after the cover body is molded. The drain passages may be partly formed in hollow portions of the frame members. Making the reinforcing frame members provided on the inside of the resin cover hollow and using the hollow portions as drain passages facilitate the formation of drain passages, allowing the formation of drain passages in the engine space using the reinforcing members also serving as drains. The inlets and outlets may be formed in the tops and bottoms of the hollow frame members in positions shifted in parallel relationships, allowing the formation of drain passages having a simple structure easily produced and good functions.

The cover body may be an undercover provided below an engine cover, defining at least a part of the engine space. In other words, the cover of this invention comprises an undercover constituting an external cover of the outboard motor, disposed below an engine cover. The hollow frame members are provided to the undercover, thereby to form the drain passages. Extraneous water entered the engine space is thus discharged from a lower portion of the undercover.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
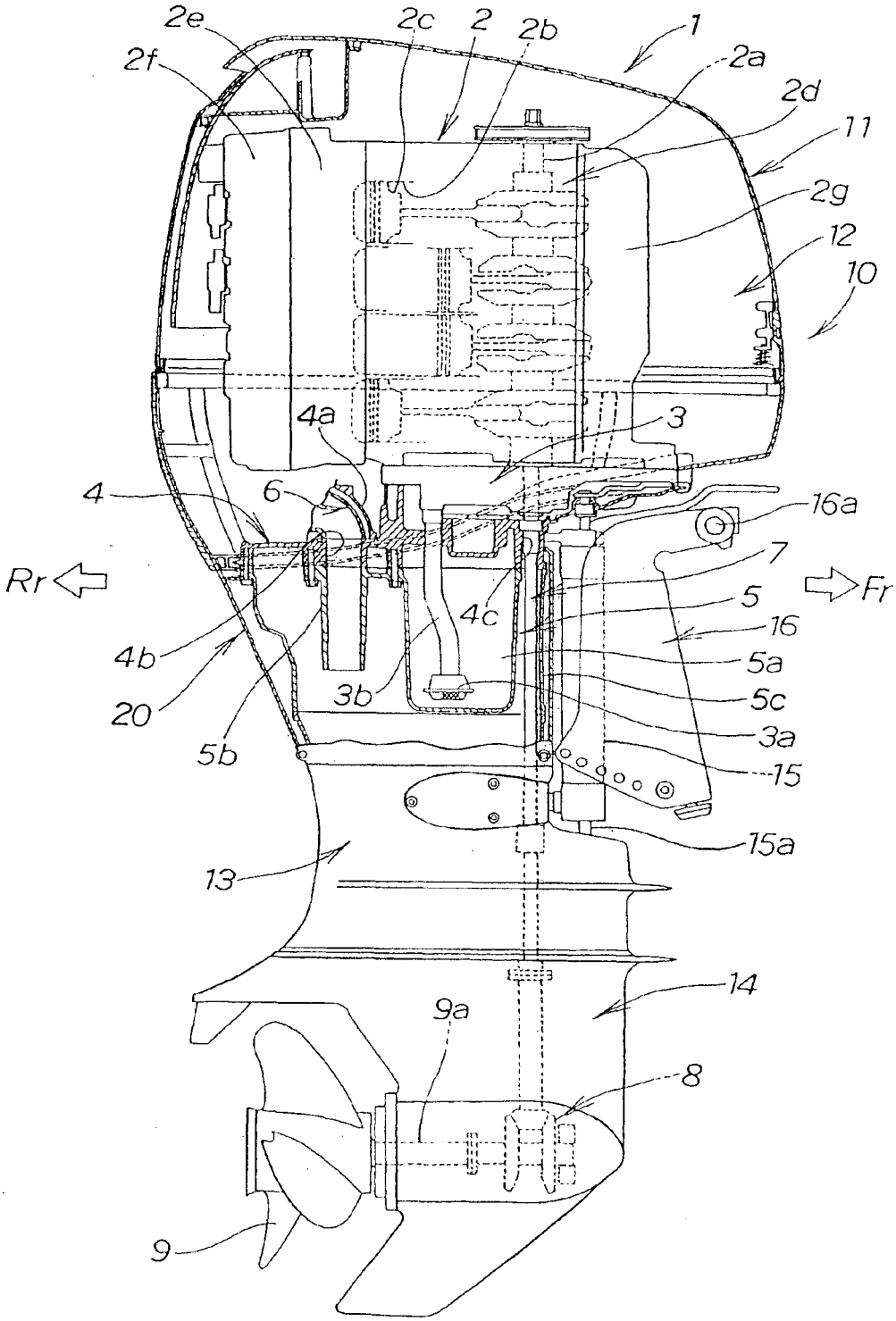
FIG. 1 is a side view, partly in cross section, of an outboard motor according to the present invention.

In FIG. 1, reference character Fr represents forward in a direction of propulsion and Rr rearward in a direction of propulsion.

An outboard motor 1 has casing means for supporting an engine and covering means for covering the engine, defining an engine space.

An engine 2 used in the outboard motor 1 in this embodiment is a vertical engine with a crank shaft 2*a* vertically oriented, a multi-cylinder engine having a plurality of cylinders 2*b* arranged one above the other with their axis lines horizontally oriented.

A piston 2*c* is fitted into each of the cylinders 2*b* of the engine 2. A cylinder block 2*d* is disposed in a middle region of the outboard motor 1 in rearward and forward directions.

At the rear of the cylinder block 2*d*, a cylinder head 2*e* is provided, at the rear of which a cylinder head cover 2*f* is provided. A crankcase 2*g* is disposed forward of the cylinder block 2*d*.

The engine 2 is supported at the bottom on a mounting case 4 via a pump body 3. An oil case 5 is provided at the underside of the mounting case 4, hanging down. In other words, the oil case 5 is fixed to the undersurface of the mounting case 4, extending downward.

An exhaust passage 5*b* is extended downward near an oil pan 5*a* of the oil case 5. The exhaust passage 5*b* is connected to a connecting hole 5*b* formed in the mounting case 4*b* for communication. Reference numeral 4*a* denotes a water jacket.

Exhaust air is guided from combustion chambers of the engine 2 through the cylinder head 2*e*, an exhaust manifold 2*h* (see FIG. 2), an exhaust guide 6, an exhaust passage 4*b* in the mounting case 4 and the exhaust passage 5*b* to the inside of an extension case 13 to be described below.

A suction tube 3*b* extends downward from the undersurface of the pump body 3 into the oil pan 5*a*, having a strainer 3*a* at the lower end located in a lower portion inside the oil pan 5*a*.

The crankshaft 2*a* is located in a forward portion of the entire outboard motor 1, the lower end of which vertically passes through the pump body 3 and connected to the upper end of a drive shaft 7 provided vertically.

The drive shaft 7 passes through a through hole 4*c* provided in a forward portion of the mounting case 4, passing between the oil pan 5*a* and a peripheral wall 5*c* of the oil case 5 and extending downward for driving an output shaft 9*a* via a transmission mechanism 8.

A propeller 9 is connected to the output shaft 9*a*. The engine 2 drives the drive shaft 7 to drive the propeller 9 via the transmission mechanism 8, thereby to provide the outboard motor 1 with a propulsion power.

A covering means 10 constituting a part of the shell member of the outboard motor 1 covers upper, side and lower portions of the engine 2. The covering means 10 consists of a cover structure having a first cover member comprised of a cap-shaped engine cover 11 oriented downward for covering an upper portion of the engine 2 above a vertically intermediate portion thereof, and a second cover member comprised of an undercover 20 for enclosing a lower portion of the engine 2, the pump body 3, the mounting case 4 and the oil case 5.

Figure 3:
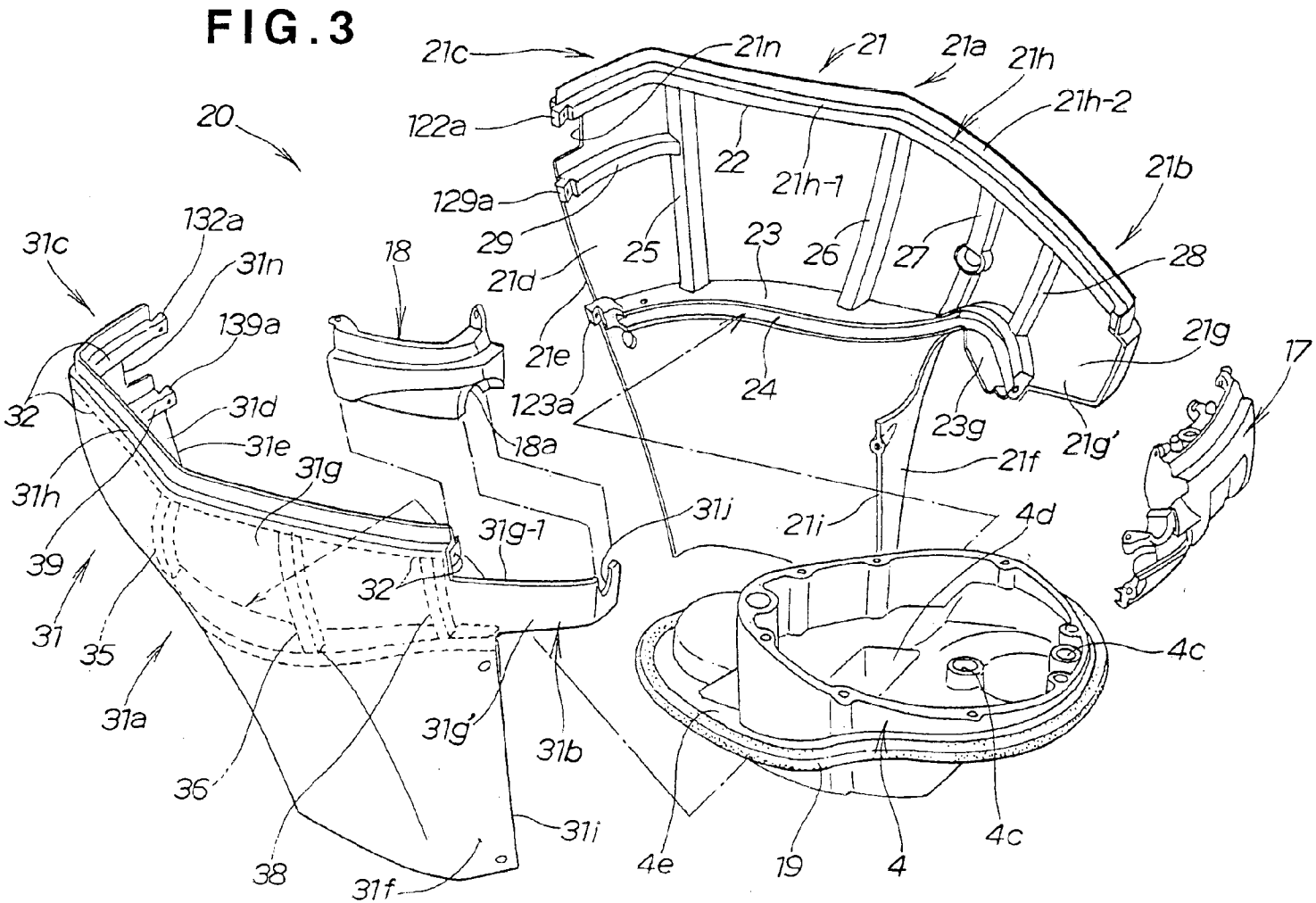
FIG. 3 is an exploded perspective view illustrating the undercover consisting of a left lower cover and a right lower cover and a mounting case.

The undercover 20, as shown in FIG. 3, consists of two cover portions, a left lower cover 21 and a right lower cover 31 as left and right cover members.

The engine space 12 is defined by the engine cover 11 and an upper portion of the undercover 20. In other words, the engine space 12 is formed by an upper portion separated from a lower portion by the mounting case 4 as will be described below. The engine space 12 is located in an upper portion of the outboard motor 1. The mounting case 4 corresponds to the bottom of the engine space 12 as will be described below.

As described above, the oil case 5 is fixed to the underside of the mounting case 4. The extension case 13 is mounted to the underside of the oil case 5. The extension case 13 is made from an aluminum alloy. A gear case 14 is connected below the extension case 13. The gear case 14 houses a lower portion of the drive shaft 7, the transmission mechanism 8 and the output shaft 9*a*.

The undercover 20 externally covers the junction between the mounting case 4 and the oil case 5. A lower portion of the undercover 20 extends downward.

The outboard motor 1 swings laterally about a swivel shaft 15*a*. The swivel shaft 15*a* is vertically provided between a forward portion of the undercover 20 and a front portion of the extension case 13. The outboard motor 1 also swings vertically about a tilt shaft 16*a*. The tilt shaft 16*a* is provided at a stern bracket 16 connected to a swivel case 15.

The mounting case 4, oil case 5, extension case 13 and gear case 14 constitute a casing assembly or casing means for supporting the engine and for rotatably supporting and accommodating the drive shaft.

Figure 2:
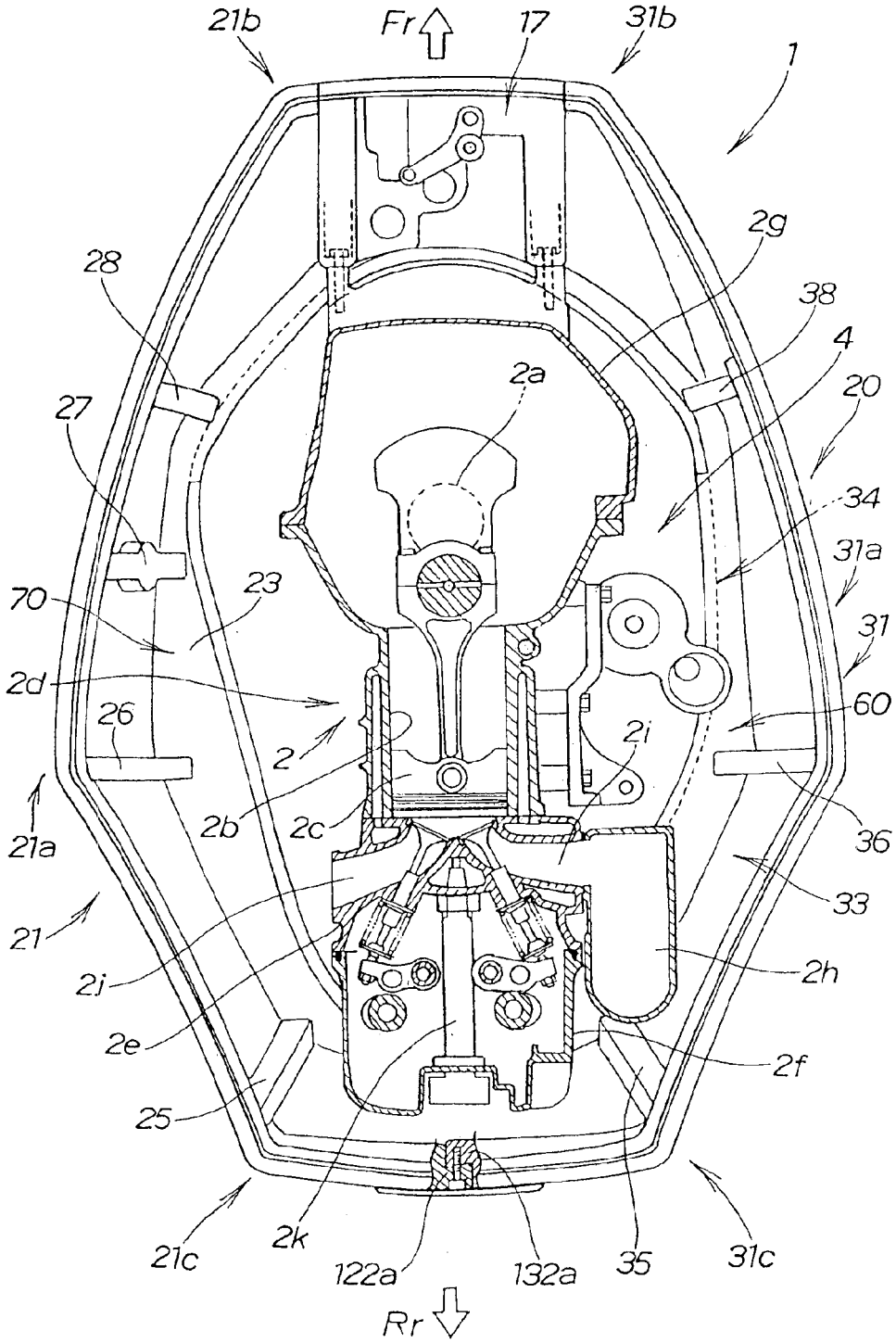
FIG. 2 is a plan view of the outboard motor with an undercover and an engine shown in cross section with an engine cover removed.

FIG. 2 illustrates, in part in cross section, the undercover 20 and the engine 2 with the engine cover 11 as an upper cover of the outboard motor 1 removed.

The undercover 20 consists of a left lower cover 21 and a right lower cover 31 which constitute left and right cover components. The left lower cover 21 and the right lower cover 31 when viewed from top have symmetrical wing-shaped cross sections with generally intermediate portions 21*a* and 31*a* bulging left and right.

As shown in FIG. 3, front and rear portions 21*b* and 21*c* of an upper half portion 21*g* of the left lower cover 21 and front and rear portions 31*b* and 31*c* of an upper half portion 31*g* of the right lower cover 31 extend in forward and rearward directions of the outboard motor 1. The front portions 21*b* and 31*b* of the left and right lower covers 21 and 31, at which the swivel case 15 and the stern bracket 16 are disposed, are hollowed in a rectangular shape toward the rear of the outboard motor 1.

As shown in FIG. 2, a cable support bracket 17 is provided between the front of the crankcase 2*g* of the engine 2 and the fronts of the left and right lower covers 21 and 31.

An exhaust passage 2*i* of the cylinder head 2*e* is connected to the exhaust manifold 2*h* for communication. An intake passage 2*j* is provided in a position opposite to the exhaust passage 2*i*. An intake manifold connected to the intake passage 2*j* for communication is not shown in the figure. Reference numeral 2*k* denotes a sparking plug.

FIG. 3 is an exploded perspective view of the left and right lower covers 21 and 31 and the mounting case 4.

The left and right lower covers 21 and 31 are made from resin such as fiber-glass reinforced plastic (polypropylene).

Figure 12:
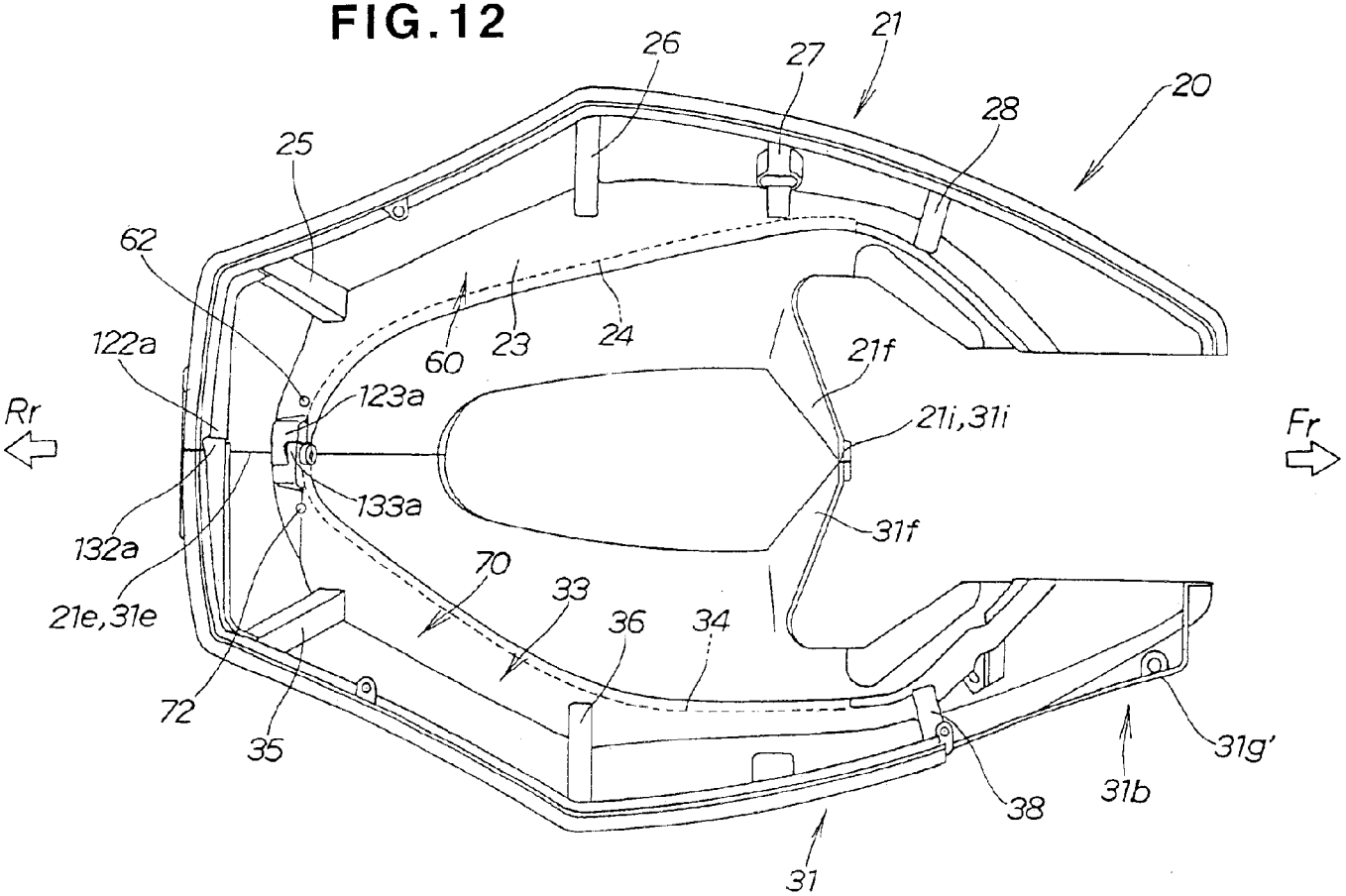
FIG. 12 is a top plan view of the left and right lower covers joined together.

Rear portions 21*d* and 31*d* of the left and right lower covers 21 and 31 have rear edges 21*e* and 31*e* opposed to one another. The rear edges 21*e* and 31*e* are butt-joined as shown in FIG. 12, serving as joint edges.

Lower half portions 21*f* and 31*f* of the left and right lower covers 21 and 31 are smaller in width in rearward and forward directions of the outboard motor (see FIG. 1) than the upper half portions 21*g* and 31*g*. A front portion 21*g*' of the upper half portion 21*g* of the left lower cover 21 is greater in vertical width than a front portion 31*g*' of the upper half portion 31*g* of the right lower cover 31. A front portion of a top portion 21*h* of the upper half portion 21*g* of the left lower cover 21 is flash with the top portion 21*h*, constituting a part of the top portion 21*h*.

The bottom edge of the front portion 31*g*' of the upper half portion 31*g* is the same in height as the bottom edge of the front portion 21*g*' of the upper half portion 21*g*. However, an upper portion of the front portion 31*g*' of the upper half portion 31*g* is cut off, so that a top edge 31*g*-1 of the front portion 31*g*' is lower in height than the top edge of the front portion 21*g*'.

The left and right lower covers 21 and 31 together form an elliptical tube elongated in rearward and forward directions and vertically split in halves with a front portion hollowed sharply and with a rear portion constricted gently. The rear portions 21*d* and 31*d* of the left and right lower covers 21 and 31 are butt-joined at the rear edges 21*e* and 31*e*. At the front, opposite front edges 21*i* and 31*i* of the lower half portions 21*f* and 31*f* are butt-joined.

With the left and right lower covers 21 and 31 joined together, the cable support bracket 17 is disposed between the front portions 21*g*' and 31*g*' of the upper half portions 21*g* and 31*g*.

On the front portion 31*g*' as a protrusion protruded forward of the right lower cover 31, a separate cover 18 is superimposed for connection. A front end portion of the separate cover 18 is formed with a notch 18*a* of a shape symmetrically corresponding to a notch 31*j* formed in a front end face of the front portion 31*g*. The notches 31*j* and 18*g* form a through hole for holding a cable with a grommet not shown.

The mounting case 4 has a connecting opening 4*d* for connecting the oil pan 5*a* (see FIG. 1) thereto and a plurality of through holes 4*c*.

An outside wall of the mounting case 4 is provided at its periphery with a flange 4*e* protruded outward, forming a part of the bottom of the engine space 12. The flange 4*e* is shaped to have a lower rear portion and a higher front portion, inclined downward from the front portion to the rear portion.

A sealing member 19 is fitted onto the flange 4*e* of the mounting case 4, surrounding the outer periphery. The sealing member 19 contacts or engages part of a reinforcing frame to be described below provided on the inside surfaces of the left and right lower covers 21 and 31.

The flange 4*e* of the mounting case 4 and the frame partly contacting or engaging the flange 4*e* constitute a partition wall for separating the engine space 12.

Now, the configuration of the left lower cover 21 will be described with reference to FIGS. 4 to 8.

The top portion 21*h* of the left lower cover 21 has a flange 21*h*-1. The flange 21*h*-1 protrudes inward, formed along the longitudinal direction of the top portion 21*h*. The top portion 21*h* is also integrally formed with a rib edge 21*h*-2 protruding upward to engage an inner edge of the cap-shaped engine cover 11 opening downward.

Reinforcing frame members 22, 23, 25, 26, 27, 28 and 29 are integrally fixed to the inside surface of the left lower cover 21. Each frame member is softer than the left lower cover 21 for moldability and has a small rectangular section, for the formation of which a material of high strength such as polypropylene is selected.

Figure 5:
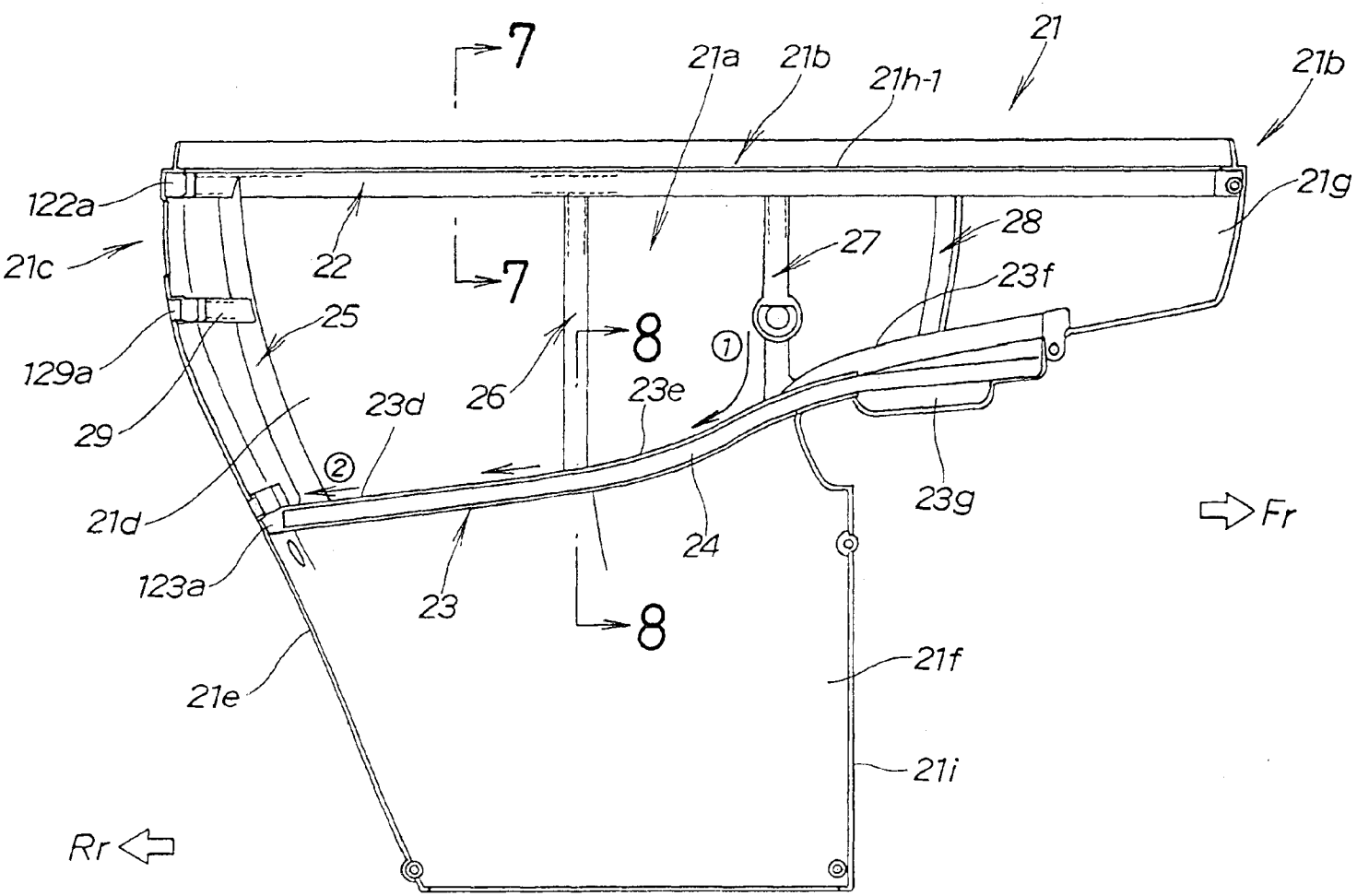
FIG. 5 is a side view as seen from inside of the left lower cover shown in FIG. 3.
Figure 7:
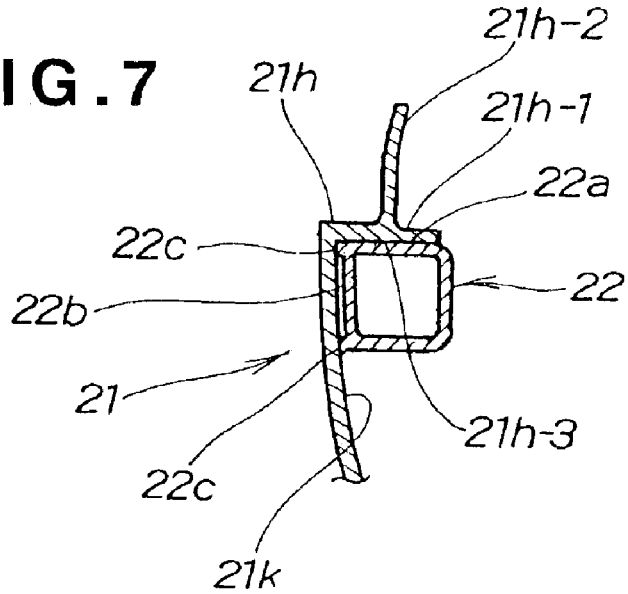
FIG. 7 is a cross-sectional view taken along line 7—7 of FIG. 5, illustrating a fixed state of an upper lateral frame member.

To the underside of the flange 21*h*-1 on the inside surface of the left lower cover 21, the upper lateral frame member 22 is fixed, extending longitudinally as shown in FIGS. 5 and 7.

The upper lateral frame member 22 is generally horizontally disposed, corresponding to the undersurface of the engine cover 11. The upper lateral frame member 22 has a hollow tube shape with a hollow cross section as shown in FIG. 7, a generally square shape in this embodiment.

After the left lower cover 21 is molded, the upper lateral frame member 22 is fixed along the inside surface of the lower cover 21 by welding or the like, integrated with the left lower cover 21.

An exemplary fixing method of the upper lateral frame member 22 will be described with reference to FIG. 7. A top surface 22*a* of the upper lateral frame member 22 is made to abut against a bottom surface 21*h*-3 of the top portion 21*h* including the flange 21*h*-1.

Protruding stripes 22*c*, 22*c* are provided at the top and bottom of an outside surface 22*b* of the upper lateral frame member 22. The protruding stripes 22*c*, 22*c* abut against an inside surface 21*k* of the cover 21. The protruding stripes 22*c*, 22*c* are vibration-welded to the inside surface below the top portion 21*h*.

As shown in FIG. 5, the lower lateral frame member 23 similar to the upper lateral frame member 22 is also fixed to a vertically intermediate portion of the inside surface of the left lower cover 21 in rearward and forward directions of the outboard motor 1 (see FIG. 1).

The lower lateral frame member 23 has a rear portion 23*d* lower in level, a front portion 23*f* higher in level, and an intermediate portion 23*e* inclined upward to the front.

Figure 4:
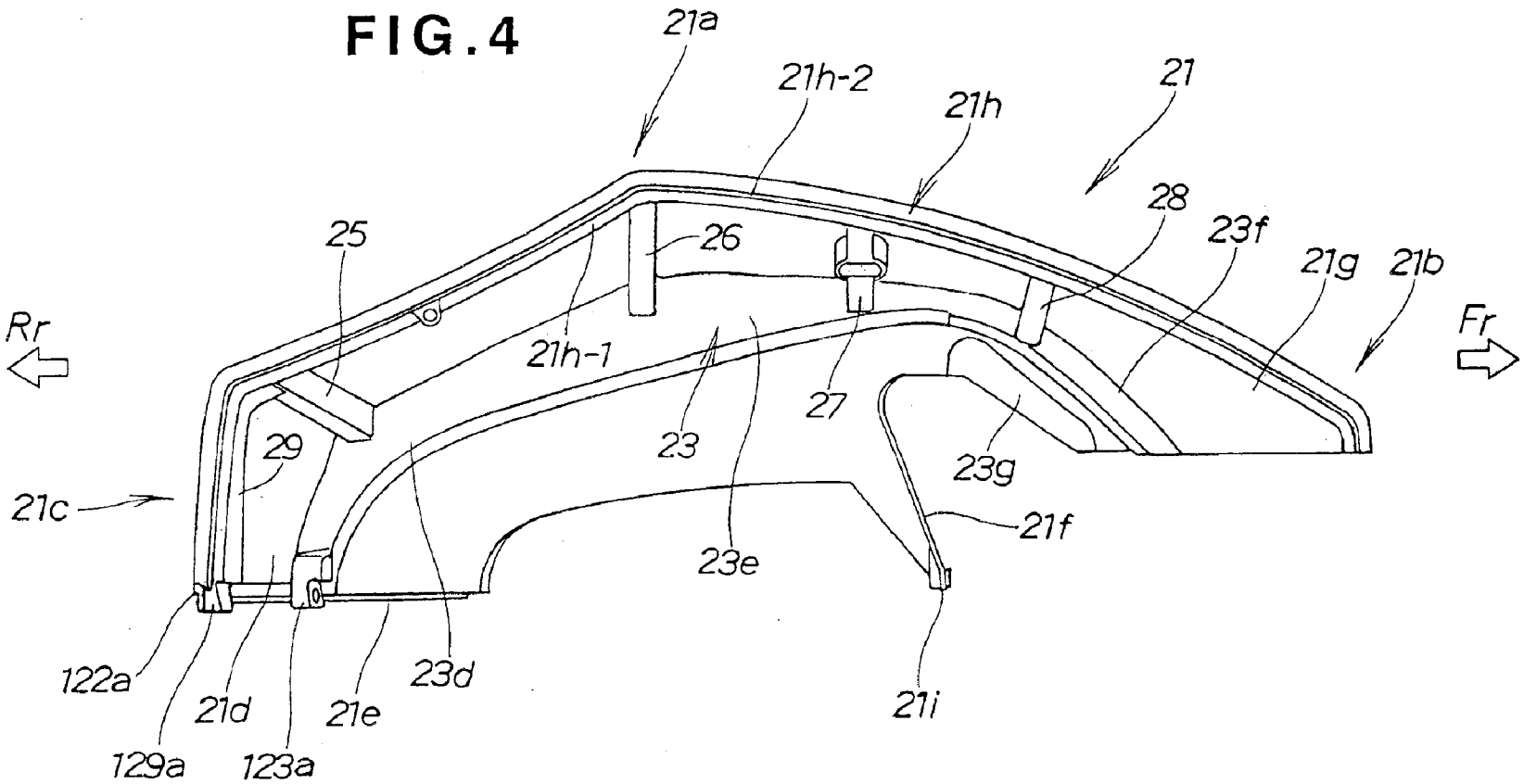
FIG. 4 is a plan view of the left lower cover of FIG. 3.

The lower lateral frame member 23 protrudes inward by a greater amount than the upper lateral frame member 22 as shown in FIG. 4. Specifically, the intermediate portion 23*e* protrudes inward by a greater amount as compared with the rear portion 23*d*, and the front portion 23*f* protrudes by a smaller amount than the rear portion 23*d*.

Figure 6:
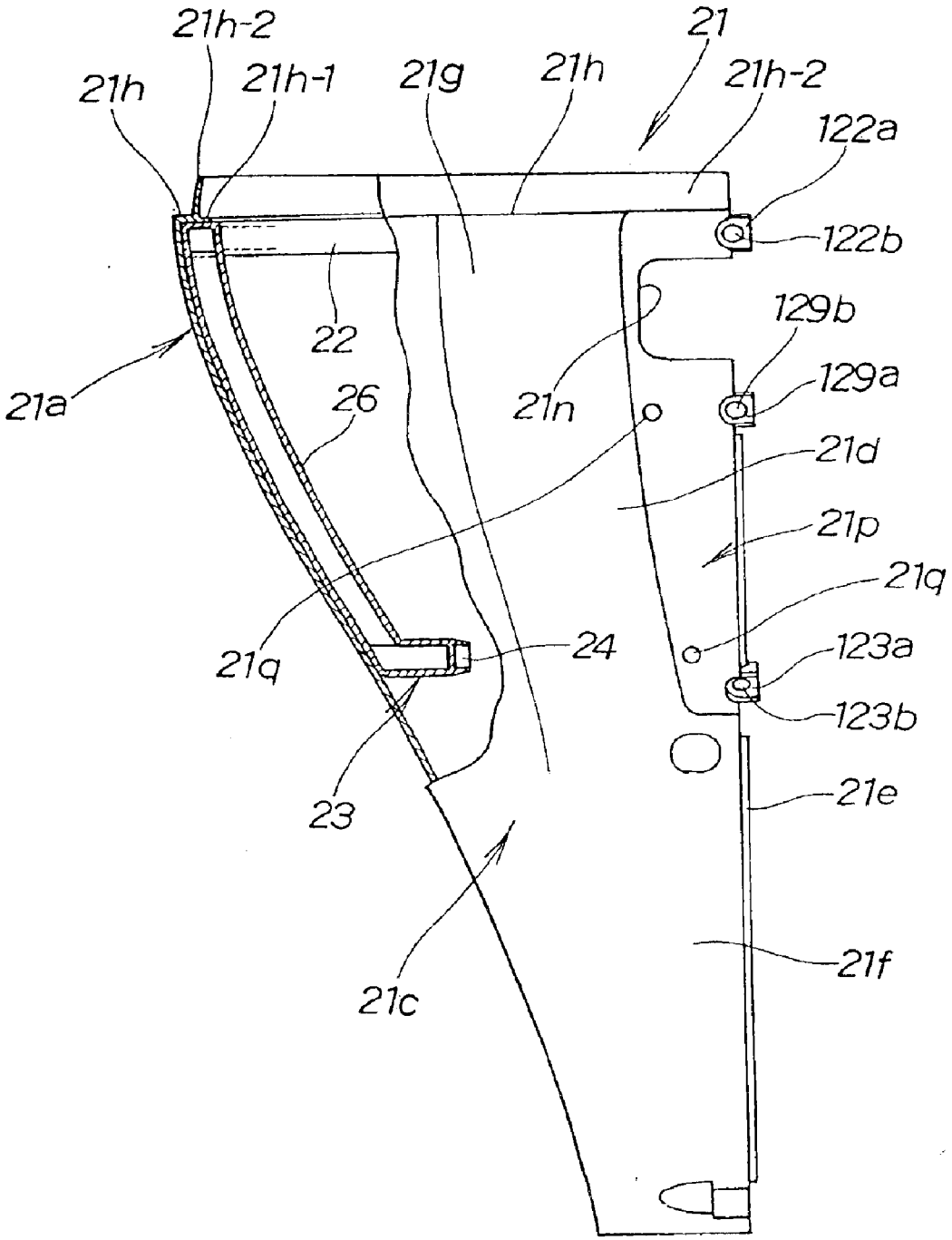
FIG. 6 is a partial sectional view from the rear of the left lower cover shown in FIG. 3.
Figure 8:
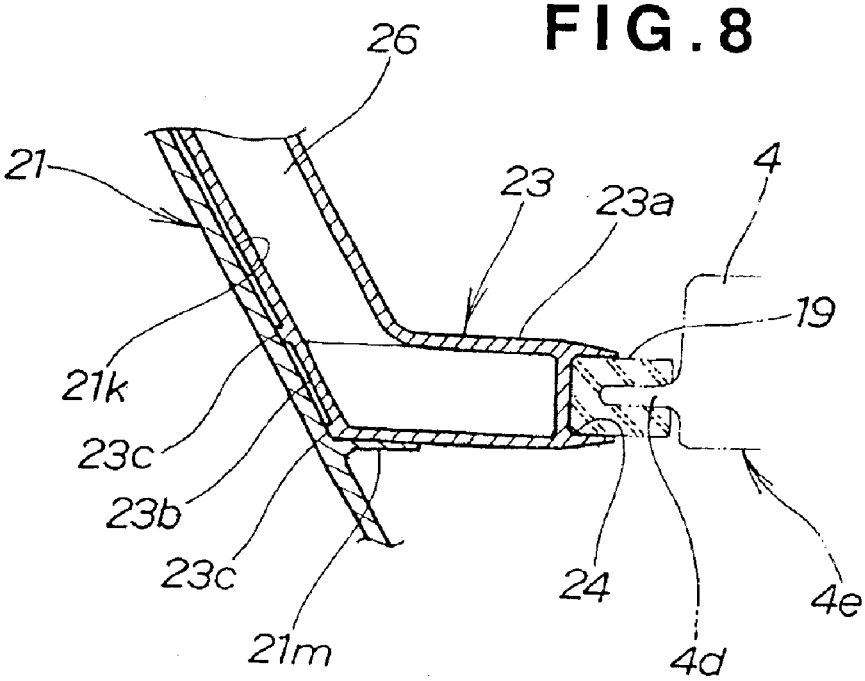
FIG. 8 is a cross-sectional view taken along line 8—8 of FIG. 5, illustrating a fixed state of a lower lateral frame member.

It is important in the lower lateral frame member 23 that, as shown in FIGS. 5, 6 and 8, an inner edge 23*a* is provided with a C-shaped hollow groove 24 opening inward.

The hollow groove 24 is formed with a large upward inclination at the front portion 23*f* of the lower lateral frame member 23 while being extended rearward more gently than the rear portion 23*d* of the lower lateral frame member 23, corresponding to a rear portion of the mounting case 4.

A flange 23*g* projecting inward is formed below the front portion 23*f* of the lower lateral frame member 23. The flange 23*g* supports a front undersurface of the mounting case 4.

The lower lateral frame member 23 is fixed in the same manner as the upper lateral frame member 22. As shown in FIG. 8, a shelf protrusion 21*m* is provided at a holding portion on the inside surface 21*k* of the left lower cover 21, on which the lower lateral frame member 23 is placed. Protruding stripes 23*c*, 23*c* are provided on an outside surface 23*b* of the lower lateral frame member 23. The protruding stripes 23*c*, 23*c* are vibration-welded to the inside surface 21*k*.

Between the rear portions, intermediate portions and front portions of the upper and lower lateral frame members 22 and 23, the vertical frame members 25, 26, 27 and 28 are provided as shown in FIGS. 3 and 5. The upper and lower lateral frame members 22 and 23 and the vertical frame members 25, 26, 27 and 28 constitute a left frame assembly.

The vertical frame members 25 to 28 are also fixed to the inside surface 21*k* of the left lower cover 21 by welding or the like, vertically connecting the upper and lower lateral frame members 22 and 23 for an increased frame rigidity. The vertical frame members 25 to 28 have hollow shapes like the upper and lower lateral frame members 22 and 23. As shown in FIG. 8, the vertical frame members 25 to 28 may be partly or at the front configured to communicate with the upper and lower lateral frame members 22 and 23. The embodiment shown in FIG. 8 illustrates the lateral frame members 22 and 23 and the vertical frame member 26 configured to communicate with one another.

FIG. 8 illustrates a state in which the sealing member 19 fitted onto an engaging rim 4*d* protruded on the periphery of the flange 4*e* of the mounting case 4*e* is fitted into the hollow groove 24 provided in the inner edge 23*a* of the lower lateral frame member 23 to retain the mounting case 4.

As shown in FIGS. 3 and 5, a sub frame member 29, an intermediate lateral frame member, is provided on a rear inner portion of the left lower cover 21, extending from a generally vertically intermediate portion of the vertical frame member 25 to the rear edge 21*e* of the left lower cover 21.

At the rear ends of the upper lateral frame member 22, lateral intermediate sub frame member 29 and lower lateral frame member 23, joint portions 122*a*, 129*a* and 123*a* having connecting holes 122*b*, 129*b* and 123*b* are integrally provided as shown in FIG. 6.

Figure 15:
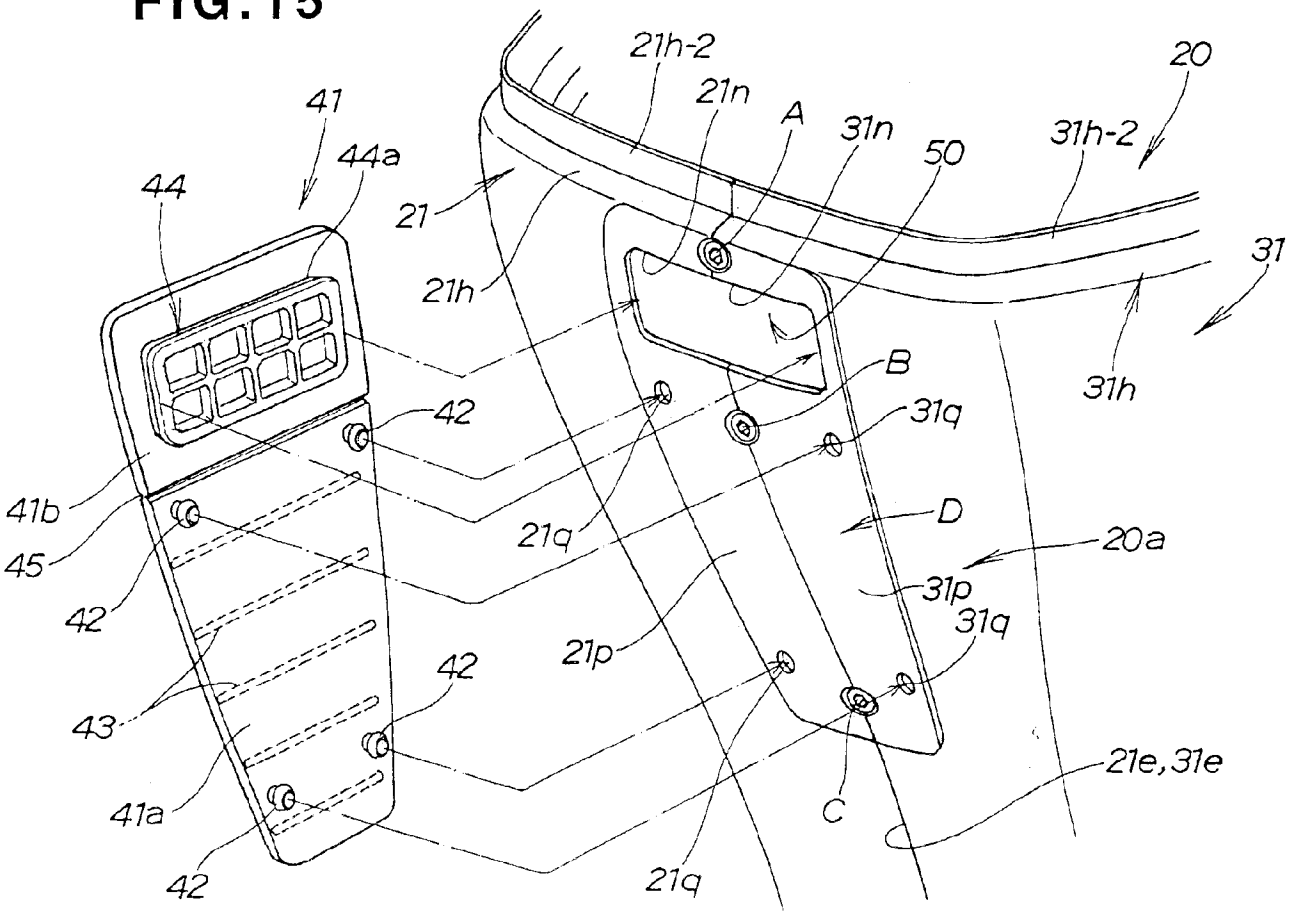
FIG. 15 is a perspective view of the rear of the undercover, illustrating mounting a lid for closing an opening.

The left lower cover 21 has, at the rear portion 21*c* as shown in FIG. 6, a hollow cut portion 21*n* opening inward to the joint edge 21*e* of the upper half portion 21*g*. The cut portion 21*n* constitutes, as shown in FIG. 15, part of a maintenance opening 50 formed by joining the left lower cover 21 and the right lower cover 31 together. A vertically-elongated bearing surface 21*p* is formed around the periphery of the hollow cut portion 21*n* in a surrounding manner. The bearing surface 21*p* has a plurality of mounting holes 21*q*.

Figure 9:
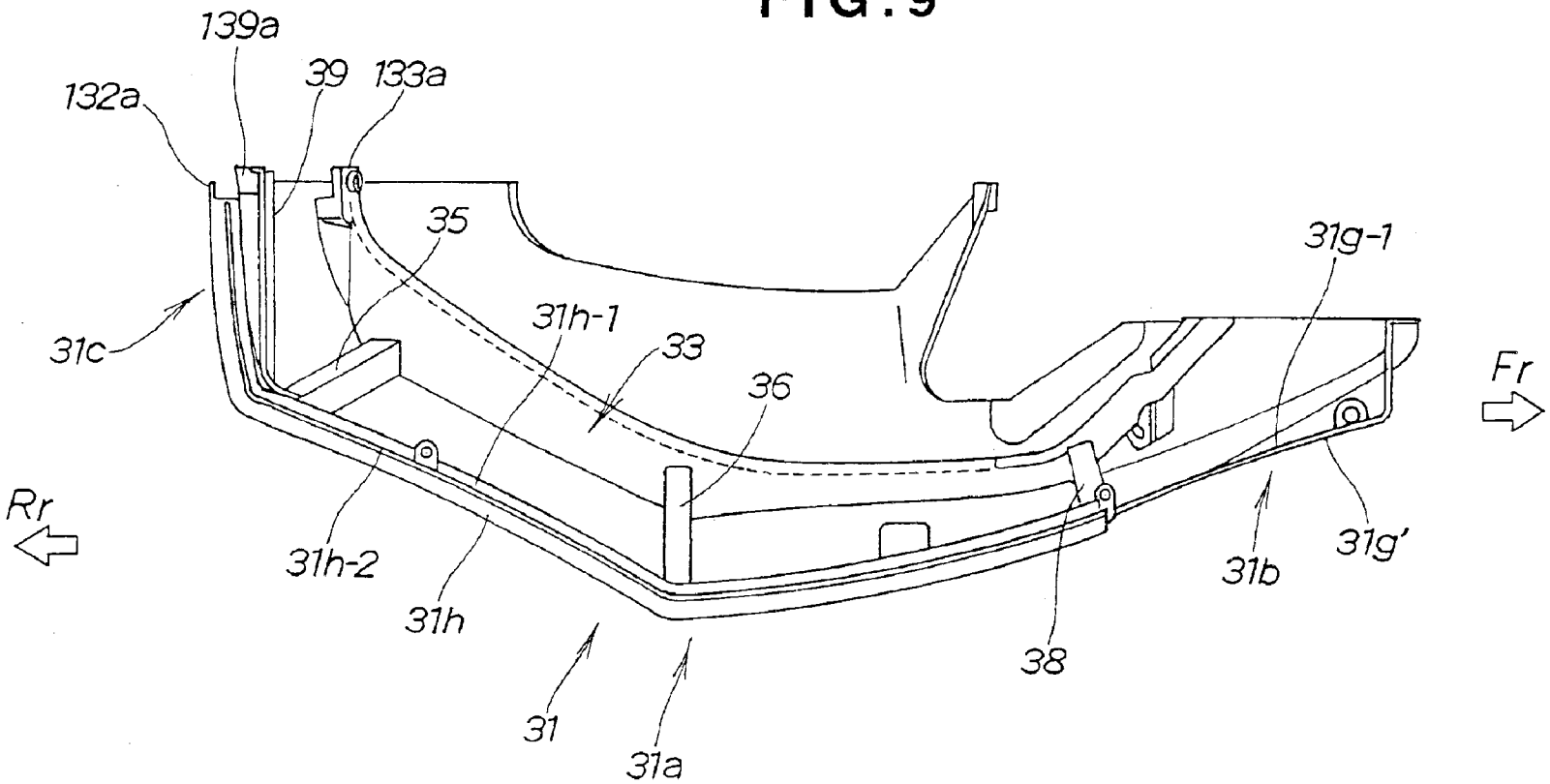
FIG. 9 is a plan view of the right lower cover of FIG. 3.

Now, the configuration of the right lower cover 31 will be described with reference to FIGS. 9 to 11.

The right lower cover 31 has a structure substantially identical to that of the left lower cover 21 shown in FIGS. 4 to 8, and the description will be made only about the components.

In those figures, reference numeral 31*h*-1 denotes a flange, 31*h*-2 a rib edge, 32 an upper lateral frame member, 33 a lower lateral frame member, 34 a hollow groove, and 35, 36 and 38 vertical frame members. The upper and lower lateral frame members 32 and 33 and the vertical frame members 35, 36 and 38 constitute a right frame assembly. Reference numeral 39 denotes a sub frame member which is hollowed like the vertical frame members 35, 36 and 38 and is fixed to an inside surface 31*k* of the right lower cover 31 by welding or the like.

Reference numeral 31*e* denotes a joint edge to be butt-joined to the joint edge 21*e* (see FIG. 3) of the left lower cover 21, and 31*i* a joint edge at the front.

Reference numerals 132*a*, 139*a* and 133*a* denote joint portions for connecting the left lower cover 21 shown in FIG. 3 and the right lower cover 31 by bolts, configured the same as those of the left lower cover 21. Reference numerals 132*b*, 139*b* and 133*b* denote mounting holes. Reference numeral 3 in denotes a hollow cut portion for forming the opening 50 shown in FIG. 15, 31*p* a bearing surface, and 31*q* mounting holes.

FIG. 12 illustrates the undercover 20 with the left and right lower covers 21 and 31 joined together. In the figure, the cable support bracket 17 is not shown for ease of understanding.

The left and right lower covers 21 and 31 are connected by bolts by a method to be described below with the joint edges 21*e* and 31*e* at the rear of the left and right lower covers 21 and 31 butt-joined, the joint edges 21*i* and 31*i* at the front butt-joined, and the joint portions 122*a*, 132*a*, 129*a*, 139*a*, 123*a* and 133*a* superimposed back and front in the embodiment shown in the figure.

The left and right lower covers 21 and 31 are connected in that manner to form the undercover 20. The lower lateral frame members 23 and 33 continuously form a flange in a loop. The hollow grooves 24 and 34 formed in the lower lateral frame members 23 and 33 are also formed in a loop. The sealing member 19 around the periphery of the mounting case 4 (see FIG. 3) is engaged with the hollow grooves 24 and 34, thereby to form a flange portion around the periphery of the mounting case 4 with the lower lateral frame members 23 and 33. The lower lateral frame members 23 and 33 and the mounting case 4 form the bottom of the engine space 12.

Figure 13:
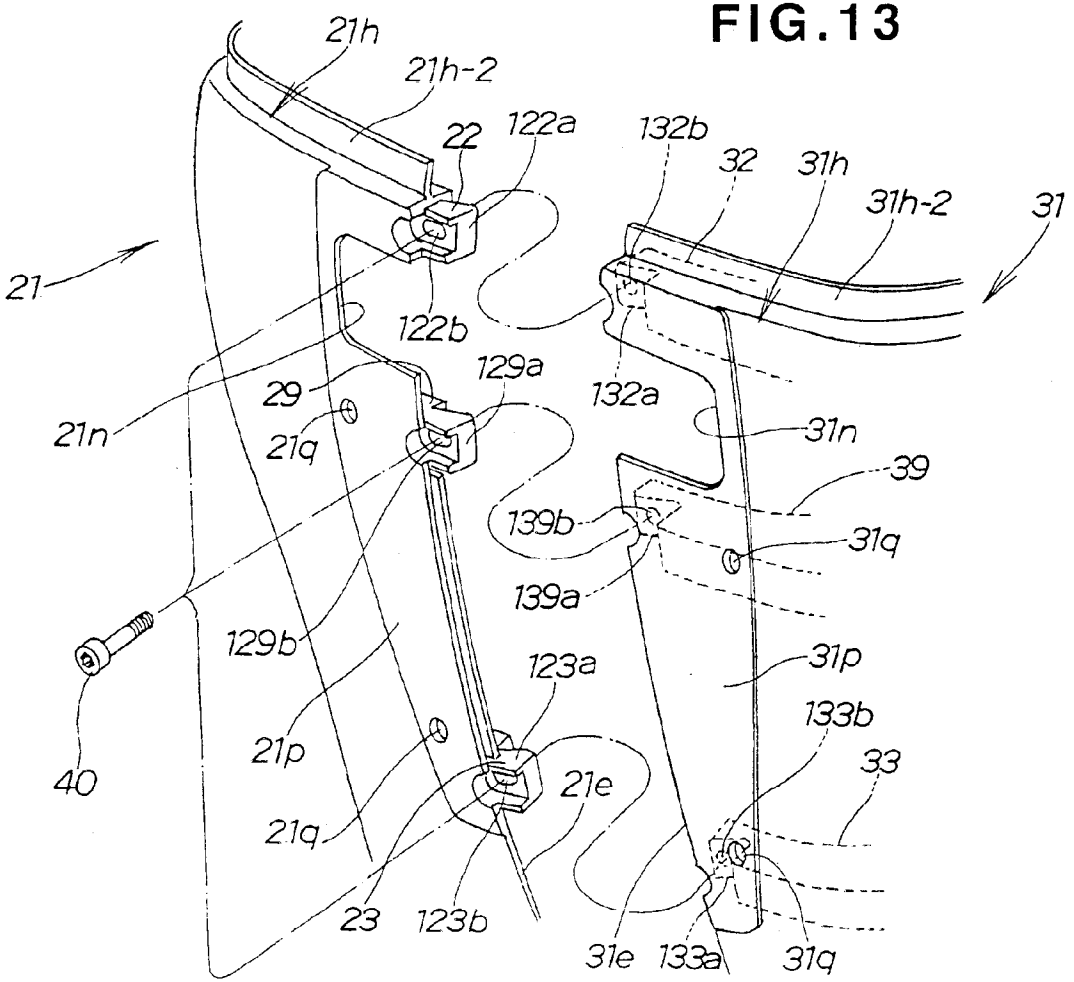
FIG. 13 is a perspective view illustrating joining rear portions of the left and right lower covers.
Figure 14:
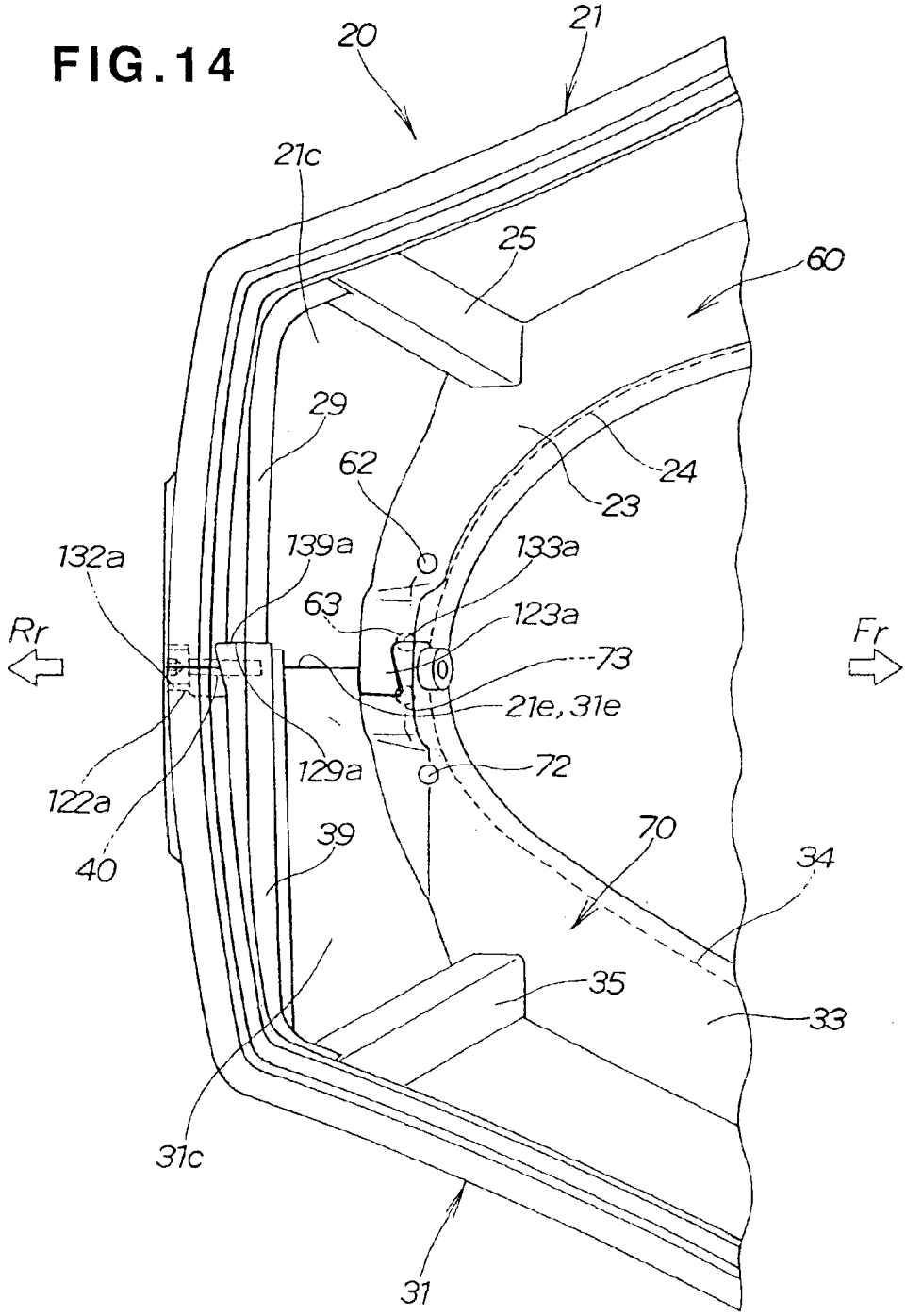
FIG. 14 is a plan view illustrating in enlargement the rear of the undercover with the left and right lower covers joined together.

FIGS. 13 and 14 illustrate joining the rear portions of the left and right lower covers 21 and 31.

To join the rear portions of the left and right lower covers 21 and 31 by butt-joining the joint edges 21*e* and 31*e* of the rear edges of the left and right lower covers 21 and 31, the joint portions 122*a*, 132*a*, 129*a*, 139*a*, 123*a* and 133*a* extended out at the ends of the upper lateral frame member 22, upper lateral frame member 32, sub frame member 29, sub frame member 39, lower lateral frame member 23 and lower lateral frame member 33, respectively, are superimposed back and front with the joint edges 21*e* and 31*e* butt-joined.

Bolts 40 are inserted through the respective mounting holes 122*b* and 132*b*, mounting holes 129*b* and 139*b* and mounting holes 123*b* and 133*b* of the superimposed joint portions 122*a*, 132*a*, 129*a*, 139*a*, 123*a* and 133*a*, so as to fasten and join the connecting portions 122*a* and 132*a*, connecting portions 129*a* and 139*a* and connecting portions 123*a* and 133*a* with the bolts 40.

For the bolt joining, nuts, for example, are embedded around the mounting holes 132*b*, 139*b* and 133*b* to screw the bolts 40 into weld nuts.

FIG. 15 illustrates mounting a lid 41 for closing the opening 50 to the rear portion of the undercover 20.

On a rear surface 20*a* of the undercover 20, a vertically-elongated generally-rectangular mounting bearing surface D is formed by joining together the mounting bearing surfaces 21*p* and 31*p* formed on the rear portions of the left and right lower covers 21 and 31. The joint edges 21*e* and 31*e* are vertically located at the transverse center of the mounting bearing surface D, and three joints A, B and C appear. The mounting holes 21*q* and 31*q* are provided in the mounting bearing surface D.

The rectangular opening 50 is formed by the hollow cut portions 21*n* and 31*n* in an upper portion of the mounting bearing surface D. With the opening 50 opened, maintenance such as the inspection, cleaning and replacement of sparking plugs at the engine cylinder head 2*e*, for example, is done by inserting tools through the opening 50.

In FIG. 15, the lid 41 closes the opening 50 and water-tightly seals the joint edge portion. The lid 41 is made from resin, synthetic rubber, rubber or the like. The lid 41 has a plane in a plate shape covering the mounting bearing surface D from the rear surface. A lower half portion 41*a* is provided at the four corners on the inner surface with a plurality of protrusions 42 to be press-fitted into the mounting holes 21*q* and 31*q* of the mounting bearing surface D for engagement. An upper half 41*b* is provided on the inner surface with a rectangular-frame-shaped sealing portion 44 having around its periphery a sealing groove 44*a* to be press-fitted into the opening 50 to engage the inner peripheral edge of the opening 50.

A hinge 45 is provided between the upper half portion 41*b* and the lower half portion 41*a* of the lid 41. A plurality of ribs 43 of protruding stripes distanced vertically from one another is provided on the outer surface of the lower half portion 41*a*.

The lid 41 is retained by press-fitting the protrusions 42 formed on the lower half portion 41*a* into the mounting holes 21*q* and 31*q* of the mounting bearing surface D. The sealing groove 44*a* of the sealing portion 44 engages the inner peripheral edge of the opening 50 by fitting the sealing portion 44 on the upper half portion 41*b* into the opening 50.

Pulling the upper half portion 41*b* of the lid 41 rearward disengages the sealing portion 44 from the opening 50. The upper half portion 41*b* bends and tilts rearward on the hinge 45, allowing access to the opening 50. By contrast, raising the upper half portion 41*b* to press-fit the sealing portion 44 into the opening 50 closes the opening 50.

Figure 16:
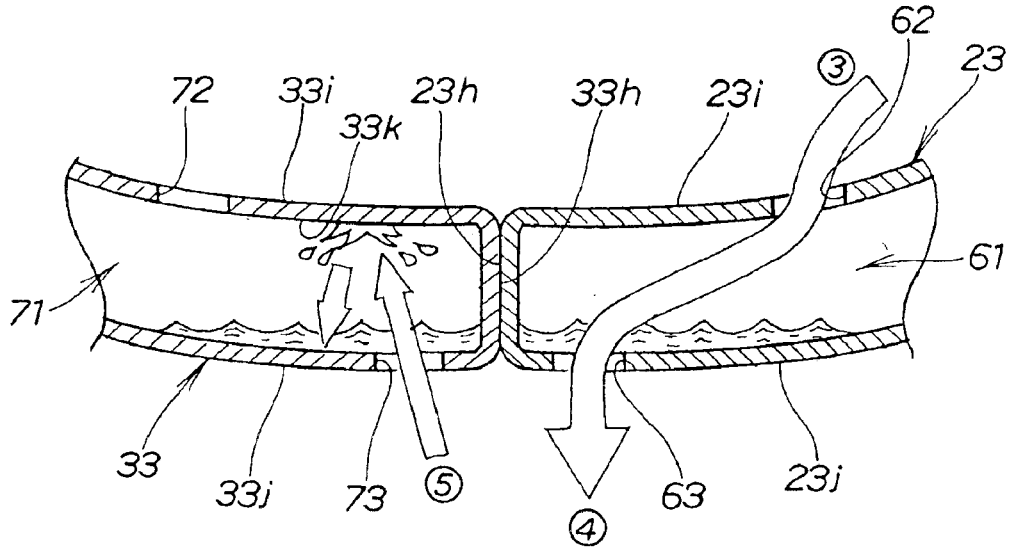
FIG. 16 is a cross-sectional view illustrating left and right lower lateral frame members provided with drain passages.

FIG. 16 illustrates the configurations of drain passages according to the present invention.

The embodiment shown in the figure illustrates an example of using the left and right lower lateral frame members 23 and 33 of the hollow frame members as drain passages.

Hollow passages 61 and 71 are formed in through the left and right lower lateral frame members 23 and 33 except the joint portions 123*a* and 133*a* (see FIGS. 5 and 10), extended to portions below the joint portions 123*a* and 133*a* with opposite ends 23*h* and 33*h* butt-joined.

Extraneous water inlets 62 and 72 are respectively formed in top surface portions 23*i* and 33*i* of the left and right lower lateral frame members 23 and 33. Extraneous water outlets 63 and 73 are respectively formed in bottom surface portions 23*j* and 33*j* of the frame members 23 and 33. The outlets and inlets 62, 63, 72, 73 communicate with the passages 61 and 71 inside the frame members 23 and 33.

The extraneous water inlets 62 and 72 are formed in positions laterally distanced from the butt-joined ends 23*h* and 33*h*. The extraneous water outlets 63 and 73 are formed in positions shifted inward from the upper inlets 62 and 72, that is, positions in the vicinities of the butt-joined ends 23*h* and 33*h*. In short, the upper inlets 62 and 72 and the lower outlets 63 and 73 are formed in distant positions in parallel relationships.

In FIG. 12, the extraneous water inlets 62 and 72 are shown on the left and right of the joint portions 123*a* and 133*a* of the left and right lower lateral frame members 23 and 33. In FIG. 14, the extraneous water inlets 62 and 72 are shown by solid lines on the left and right of the joint portions 123*a* and 133*a* of the lower lateral frame members 23 and 33, and the outlets 63 and 73 are shown by broken lines in laterally closer portions.

Extraneous water entering the engine space 12 thus comes down along the inner wall of the undercover 20.

Figure 10:
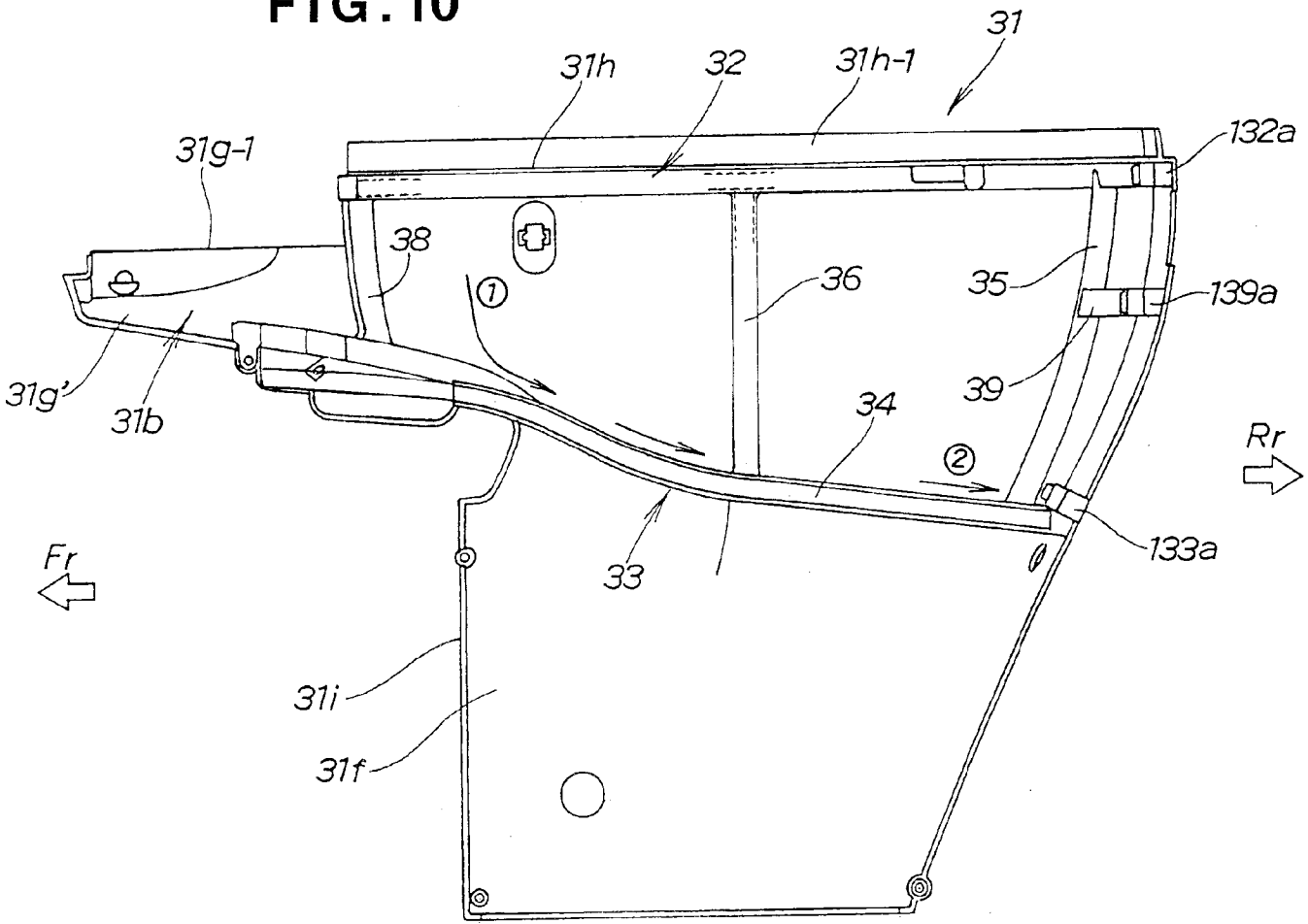
FIG. 10 is a side view from inside of the right lower cover of FIG. 3.
Figure 11:
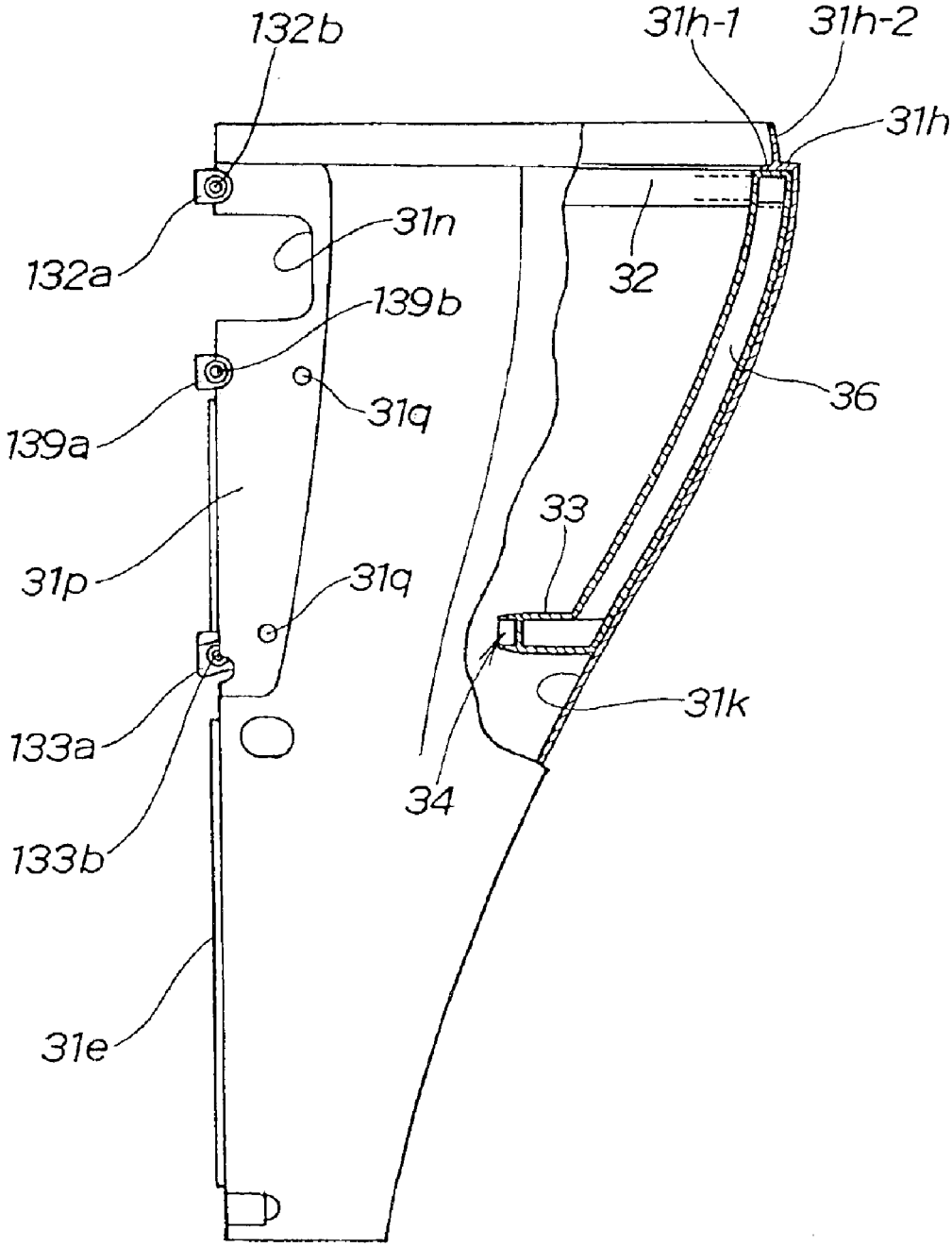
FIG. 11 is a partial sectional view from the rear of the right lower cover shown in FIG. 3.

The lower lateral frame members 23 and 33 formed on the inside of the undercover 20 located in the engine space 12 are higher at the front (Fr side) and lower at the rear (Rr side) as shown in FIGS. 5 and 10. Extraneous water entering the engine space 12 thus comes, even at the forefront, for example, downward as shown by arrow ① and flows rearward along the slope inclined downward to the rear of the lower lateral frame members 23 and 33. The water finally collects in the direction of the lowest joint portions 123*a* and 133*a* of the lower lateral frame members 23 and 33 as shown by arrow ② and flows from those portions into the drain passages 61 and 71 through the inlets 62 and 72 which are provided in those portions as drainage holes.

As shown in FIG. 2, the top surfaces of the lower lateral frame members 23 and 33 and the top surface of the flange 4*e* of the mounting case 4 constitute a terrace for guiding extraneous water. As indicated by reference numerals 60 and 70 in FIGS. 2, 12 and 14, the top surfaces of the lower lateral frame members 23 and 33 have large areas and are inclined downward to the rear as described above. Extraneous water entering the engine space 12 shown in FIG. 1 is thus effectively collected to the drain passage inlets 62 and 72.

As shown in FIG. 16, extraneous water entering the engine space 12 flows downward and rearward of the engine 2 as described above and flows into the drain passage 61 in the frame member 23 through the inlet 62 as shown by arrow ③.

The inflow water is discharged downward of the undercover 20 through the outlet 63 displaced in parallel from the inlet 62. As shown in the figure, the drain passages 61 and 71 including joint portions of the lower lateral frame members 23 and 33 are slightly inclined downward at the laterally (transversely) central portion of the undercover 20 so as to lower the opposite ends 23*h* and 33*h*. As a result, the outlets 63 and 73 are inclined in the directions of the outlets 63 and 73, located in lower levels, so that water flowing through the inlets 62 and 72 into the drain passages 61 and 71 is smoothly discharged.

With FIG. 16, the water collection and drainage have been described with respect to the right drain passage 61. The same holds true for the left drain passage 71.

As shown in the left drain passage 71 in FIG. 16, extraneous Water entering from below the outboard motor 1 due to waves enters through the outlet 73 opening downward into the drain passage 71 as shown by arrow ⑤.

The water entering the drain passage 71 is prevented from reaching the inlet 72 because the inlet 72 is provided in a position distanced in parallel from the outlet 73, and strikes a ceiling portion 33*k* of the drain passage 71. As a result, the power of the inflow water is attenuated. The water entering the passage 71 thus comes down. The extraneous water entering the drain passage 71 through the lower outlet 73 is thus prevented from entering the undercover 20, that is, the engine space 12 through the inlet 72 opening upward.

The description has been made with the figure about the entering of extraneous water through the left outlet 73. The same holds true for the entering of extraneous water through the right outlet 63.

The present disclosure relates to the subject matters of Japanese Patent Applications No. 2002-209990 and No. 2002-210014, both filed Jul. 18, 2002, the disclosures of which are expressly incorporated herein by reference in their entireties.

What is claimed is:

1. An outboard motor comprising:

an engine;

a propeller drivable by the engine;

a drive shaft for transmitting a driving force from the engine to the propeller;

a casing assembly supporting the engine and rotatably supporting and accommodating the drive shaft; and a cover structure defining at least part of an engine space accommodating therein the engine, the cover structure having a resin cover body comprised of at least first and second cover members detachably connected to one another, and a frame assembly integrally connected to an inner surface of the first cover member for reinforcement thereof, the first cover member having an opened flange receiving a seal of the second cover member, and the frame assembly extending along a contour of the opened flange.

2. An outboard motor according to claim 1; wherein the first cover member of the resin cover body has holding portions connecting the frame assembly to the inner surface of the first cover member.

3. An outboard motor according to claim 1; wherein the frame assembly of the resin cover body comprises a plurality of frame members forming a flange at a lower periphery of the engine space.

4. An outboard motor according to claim 1; wherein the resin frame assembly comprises a plurality of lateral frame members and a plurality of vertical frame members connecting the lateral frame members together, the lateral frame members being disposed at upper and lower portions of the inner surfaces of the resin cover body and extending between rearward and forward ends of the inner surfaces of the resin cover body.

5. An outboard motor comprising:

an engine;

a propeller drivable by the engine;

a drive shaft for transmitting a driving force from the engine to the propeller;

means defining a casing for supporting the engine and for rotatably supporting and accommodating the drive shaft; and a cover defining a part of an engine space for accommodating therein the engine, the cover having a cover body defining a portion of the engine space and a resin frame assembly integrally connected to inner surfaces of the cover body, the cover body having a plurality of drain passages extending from an interior of the cover body to an exterior thereof, each of the drain passages having an inlet opening into the interior of the cover body and an outlet communicating with the exterior of the cover body, the inlets being spaced-apart and generally parallel to the outlets.

6. An outboard motor according to claim 5; wherein the cover body is made of a resin material and has frame members integrally connected to the inner surface of the cover body, the drain passages being formed in hollow portions of the frame members.

7. An outboard motor according to claim 5; further comprising an engine cover for covering an upper part of the engine; and wherein the cover body comprises an undercover disposed below the engine cover.

8. An outboard motor comprising:

an engine;

a propeller drivable by the engine;

a drive shaft for transmitting a driving force from the engine to the propeller;

means defining a casing for supporting the engine and for rotatably supporting and accommodating the drive shaft;

a mounting case for supporting a bottom portion of the engine; and a cover defining at least part of an engine space for accommodating therein the engine, the cover having a resin cover body and a resin frame assembly integrally connected to inner surfaces of the resin cover body, the resin frame assembly having a plurality of frame members engageable with a peripheral portion of the mounting case.

9. In an outboard motor having an engine, a cover structure for covering the engine, the cover structure comprising:

a mounting case for supporting the engine, the mounting case having a flange portion and a seal member disposed on the flange portion;

a first cover member for covering an upper portion of the engine;

a second cover member connected to the first cover member for covering the mounting case and a lower portion of the engine; and a plurality of reinforcing frame members connected to inner surfaces of the second cover member for reinforcing the second cover member, at least one of the reinforcing frame members having a groove for receiving therein at least a portion of the mounting case seal member.

10. An outboard motor according to claim 9; wherein the second cover member has a pair of cover portions detachably connected together and each having a plurality of the reinforcing frame members connected to inner surfaces thereof.

11. An outboard motor according to claim 10; wherein the at least one of the reinforcing frame members comprises two reinforcing frame members each corresponding to one of the reinforcing frame members of each of the pair of cover portions, the two reinforcing frame members jointly forming the groove for receiving the mounting case seal member.

12. An outboard motor according to claim 9; wherein the second cover member and the reinforcing frame members are made of a resin material.

13. An outboard motor according to claim 9; wherein the first cover member, the second cover member, and the reinforcing frame members are made of a resin material.

* * * * *